US009994789B2

(12) United States Patent
DeBlase et al.

(10) Patent No.: US 9,994,789 B2
(45) Date of Patent: Jun. 12, 2018

(54) FRICTION MODIFIER COMPOSITION FOR LUBRICANTS

(71) Applicant: Chemtura Corporation, Middlebury, CT (US)

(72) Inventors: Frank J. DeBlase, Hopewell Junction, NY (US); Venkatramanan K. Madabusi, Naugatuck, CT (US); Susan Ferrarotti, New Hartford, CT (US); Faith Angela Arifian, Roxbury, CT (US); Cyril A. Migdal, Pleasant Valley, NY (US); Gerard Mulqueen, Lincolnshire (GB)

(73) Assignee: LANXESS Solutions US Inc., Middlebury, CT (US)

( * ) Notice: Subject to any disclaimer, the term of this patent is extended or adjusted under 35 U.S.C. 154(b) by 0 days. days.

(21) Appl. No.: 15/432,496

(22) Filed: Feb. 14, 2017

(65) Prior Publication Data

US 2017/0152459 A1 Jun. 1, 2017

Related U.S. Application Data

(63) Continuation of application No. 15/073,922, filed on Mar. 18, 2016, now abandoned, which is a continuation-in-part of application No. 13/780,511, filed on Feb. 28, 2013, now Pat. No. 9,321,979.

(60) Provisional application No. 61/610,100, filed on Mar. 13, 2012.

(51) Int. Cl.

| | |
|---|---|
| ***C10M 169/04*** | (2006.01) |
| ***C10M 129/76*** | (2006.01) |
| ***C10M 135/18*** | (2006.01) |
| ***C10M 141/06*** | (2006.01) |

(52) U.S. Cl.

CPC ..... *C10M 169/04* (2013.01); *C10M 141/06* (2013.01); *C10M 2203/003* (2013.01); *C10M 2203/1006* (2013.01); *C10M 2207/289* (2013.01); *C10M 2219/068* (2013.01); *C10N 2230/02* (2013.01); *C10N 2230/04* (2013.01); *C10N 2230/06* (2013.01); *C10N 2230/10* (2013.01); *C10N 2230/12* (2013.01); *C10N 2230/18* (2013.01); *C10N 2230/36* (2013.01)

(58) Field of Classification Search

CPC ..... C10M 169/04; C10M 2207/282; C10M 2207/289; C10M 141/06; C10M 2203/003; C10M 2203/1006; C10M 2219/068; C10N 2230/0204; C10N 2230/06; C10N 2230/10; C10N 2230/12; C10N 2230/18; C10N 2230/36

USPC ..... 508/167

See application file for complete search history.

(56) References Cited

U.S. PATENT DOCUMENTS

| | | | | |
|---|---|---|---|---|
| 7,696,136 | B2 * | 4/2010 | Migdal | C10L 1/19 44/388 |
| 2010/0197536 | A1 * | 8/2010 | Mosier | C10M 141/12 508/167 |

* cited by examiner

*Primary Examiner* — James Goloboy
(74) *Attorney, Agent, or Firm* — Dilworth IP LLC

(57) ABSTRACT

Combining a metal based friction modifier, such as a molybdenum dialkyldithiocarbamate, and certain esters of hydroxy carboxylic acids, such as short chain alkyl esters of citric or tartaric acid, e.g., tributyl citrate, has a synergistic effect on lowering the friction coefficient of lubricating oils allowing one to reduce the amount of metal based friction modifier needed to adequately formulate a lubricant with low friction characteristics.

3 Claims, No Drawings

FRICTION MODIFIER COMPOSITION FOR LUBRICANTS

This invention provides a synergistic friction modifier composition for lubricants, said composition comprising a metal based friction modifier, such as a molybdenum dialkyldithiocarbamate, and certain esters of hydroxy carboxylic acids, for example, short chain alkyl esters of citric or tartaric acid such as tributyl citrate.

BACKGROUND OF THE INVENTION

Lubricants, such as lubricating oils and greases, are subject to deterioration at elevated temperatures, extreme contact pressures, or upon prolonged exposure to the elements. Such deterioration is evidenced in many instances by an increase in acidity and viscosity. It can cause metal parts to corrode and often leads to a loss of lubrication properties resulting in wear at the surfaces being lubricated, e.g., metal engine parts and the like.

A variety of additives have been developed to provide, antioxidant, antiwear, and deposit control properties etc, to these lubricants. Additives have also been developed to modify the lubricity and load bearing properties of the lubricant. For example, zinc dialkyldithiophosphates (ZDDP) have been used as antifatigue, antiwear, antioxidant, extreme pressure and friction modifying additives for lubricating oils for many years. However, ZDDPs are subject to several drawbacks due to the presence of zinc and phosphorus. For example, the presence of zinc contributes to emission of particulates in the exhaust.

Reducing friction between moving parts is of course a fundamental role of lubricants. This is especially significant in internal combustion engines and power transmission systems found in cars and trucks, for example, in part because a substantial amount of the theoretical mileage lost from a gallon of fuel is traceable directly to friction.

A variety of friction modifiers are widely known and used, including for example, fatty acid esters and amides, and organo molybdenum compounds, such as molybdenum dialkyldithiocarbamates, molybdenum dialkyl dithiophosphates, molybdenum disulfide, tri-molybdenum cluster dialkyldithiocarbamates, non-sulfur molybdenum compounds and the like.

Molybdenum friction modifiers are widely known and are effective over a broad temperature range, especially upon reaching temperatures of ~120° C. or higher where chemical transformations form Mo-Sulfide glass coatings on surfaces. Molybdenum compounds however have some drawbacks, for example they can complex and interfere with dispersants and like other metal containing compounds, may suffer from particulate formation etc, as seen, for example, with the zinc anti-wear additive above. It is therefore desirable to reduce the amount of such friction modifiers in lubricants.

U.S. Pat. No. 5,338,470 discloses alkylated citric acid adducts, i.e., citrate esters, as antiwear and friction modifying additives for fuel and lubricants formed by reacting citric acid with 1, 2 or 3 equivalents of an alcohol. The anti-wear properties and friction reduction of compound mixtures derived from citric acid and oleyl alcohol are demonstrated.

U.S. Pat. No. 7,696,136 discloses lubricant compositions containing esters of hydroxy carboxylic acids, such as citrates and tartrates, which are useful as non-phosphorus-containing, anti-fatigue, anti-wear, extreme pressure additives for fuels and lubricating oils. The esters are used alone or in combination with a zinc dihydrocarbyldithiophosphate or an ashless phosphorus-containing additive, such as tri-lauryl phosphate or triphenylphosphorothionate. The addition of short chain esters, such as tri-ethyl citrate, borated tri-ethyl citrate and di butyl tartrate are shown to allow one to reduce the amount of ZDDP while maintaining good anti-wear properties.

It has now been found that while certain short chain esters of U.S. Pat. No. 7,696,136, e.g., tributyl citrate, can provide a modest decrease in friction coefficient of a lubricating oil, e.g., when added to a lubricant base stock or a commercial lubricant oil such as commercially available SAE 10-40, SAE 10-20, SAE 5-30 automotive oils etc, a much greater effect is seen when the citrate is combined with certain metal based friction modifiers, such as molybdenum friction modifiers. The surprisingly large synergy seen allows one to significantly reduce the amount of metal containing additives in lubricants, such as lubricants used in engines and power transmission systems.

SUMMARY OF THE INVENTION

A surprising reduction in the friction coefficient of lubricating oils is obtained by blending metal based friction modifiers, such as organo molybdenum friction modifiers, with short chain alkyl esters, e.g., $C_{1-8}$ alkyl, $C_{1-6}$ alkyl or $C_{1-4}$ alkyl esters, of hydroxy carboxylic acids, for example, esters of formula:

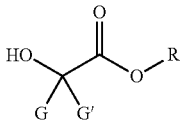

wherein each R is an independently selected $C_{1-8}$ straight or branched chain alkyl;

G is COOR, $(CH_2)_{1-3}$COOR or $(CHOH)_{1-3}$COOR; and

G' is H, $(CH_2)_{1-3}$COOR or $(CHOH)_{1-3}$COOR.

The esters of the invention can be substituted for at least a portion of a metal based friction modifiers generally encountered in lubricant compositions, while maintaining excellent performance, especially at higher temperatures, e.g., 100° C. or above, allowing one to use less metal in lubricating oils, such as those for automotive applications.

DESCRIPTION OF THE INVENTION

The invention provides a lubricant composition comprising:

A) a natural or synthetic lubricating oil, and

B) from about 0.01 to about 5 wt %, based on the weight of the lubricant composition, of a mixture of i) a metal based friction modifier such as a molybdenum friction modifier, and ii) a hydroxy carboxylic ester of formula I:

I

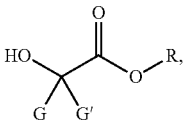

wherein each R is an independently selected $C_{1-8}$ straight or branched chain alkyl;

G is COOR, $(CH_2)_{1-3}$COOR or $(CHOH)_{1-3}$ COOR; and

G' is H, $(CH_2)_{1-3}$ COOR or $(CHOH)_{1-3}$ COOR.

The weight ratio of component i) to ii) is typically from about 3:1 to about 1:9 based on the total weight of metal based friction modifier i) and hydroxy carboxylic ester ii). For example, the ratio by weight of i) to ii) is from about 2:1 to about 1:9, e.g., from about 2:1 to about 1:5 or 1:1 to 1:9. For example, component i) may be present in a greater amount than, or the same amount as, component ii), e.g., in a ratio of 3:1, 2:1 1.5:1 or 1:1. In many embodiments however, component i) is present in the same amount or less than the amount of component ii) for example, the ratio of i to ii is 1:1, 1:1.5, 1:2, 1:3, 1:4, 1:5 or up to 1:9. Generally the weight ratio of i to ii is from about 1.5:1 to about 1:9, or about 1.5:1 to about 1:5, such as about 1:1 to about 1:5, about 1:1 to about 1:4 or from about 1:1 to about 1:3.

Generally the mixture of metal based friction modifier i) and hydroxy carboxylic ester ii) is present from about 0.01 to about 3 wt %, for example about 0.5 or 0.1 to about 2 wt %, or from about 0.1 or 0.5 to about 1.5 wt %, based on the weight of the lubricant composition.

In certain particular embodiments the mixture of metal based friction modifier i) and hydroxy carboxylic ester ii) is present from about 1.0 to about 5 wt %, for example about 1.5 or 2.0 to about 4.5 or 4.0 wt %, or from about 1.5 or 2.5 to about 3.5 or 3.0 wt %, based on the weight of the lubricant composition.

In many embodiments the amount of metal based friction modifier i) present in the composition is in at least 0.5 wt %, e.g., from 0.5 to about 0.2 wt % or from 0.75 wt % to about 1.5 or about 1.0 wt %, and the hydroxy carboxylic ester ii) is present in at least 0.5 wt %, e.g., from about 0.5 to about 3.5 wt %, e.g., from about 0.75 to about 3.5, about 3.0 or about 2.5 wt %.

In many embodiments, the hydroxy carboxyl ester comprises one or more esters of citric acid and/or tartaric acid, for example, compounds of the formulae II and/or III

II

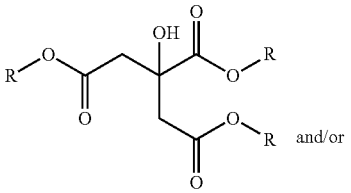

and/or

III

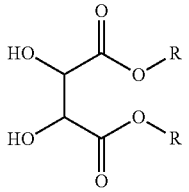

wherein R is selected from $C_{1-8}$ straight or branched chain alkyl. In many embodiments R is selected from $C_{1-6}$ straight or branched chain alkyl, for example R is selected from $C_{1-4}$ straight or branched chain alkyl or R is selected from $C_{2-6}$ or $C_{3-6}$ straight or branched chain alkyl. For example, the hydroxy carboxyl ester comprises at least one $C_{2-6}$ alkyl ester of citric acid.

$C_{1-8}$ straight or branched chain alkyl is, for example, selected from methyl, ethyl, propyl, isopropyl, butyl, isobutyl, sec-butyl, tert-butyl, pentyl, tert-pentyl, ethylpropyl, isomers of methyl butyl, hexyl, isomers of methylpentyl, isomers of ethylbutyl, heptyl, isomers of methylhexyl, isomers of ethylpentyl, isomers of propylbutyl, octyl, isomers of methylheptyl, isomers of ethylhexyl, isomers of propylpentyl, and tert-octyl.

$C_{1-6}$ straight or branched chain alkyl is, for example, selected from methyl, ethyl, propyl, isopropyl, butyl, isobutyl, sec-butyl, tert-butyl, pentyl, tert-pentyl, isomers of methyl butyl, ethylpropyl, hexyl, isomers of methylpentyl and isomers of ethylbutyl.

$C_{1-4}$ straight or branched chain alkyl is, for example, selected from methyl, ethyl, propyl, isopropyl, butyl, isobutyl, sec-butyl and tert-butyl. For example, R is selected from methyl, ethyl, propyl and butyl.

In some particular embodiments R is $C_{3-6}$ straight or branched chain alkyl, and in certain embodiments R is $C_{3-6}$ straight chain alkyl, for example, linear butyl.

While each R in formula I, II, or III may be different, in many embodiments, each R is the same. For example, in many embodiments, the hydroxy carboxy ester is selected from trimethyl, triethyl, tri-propyl, and tri-butyl citrate or dimethyl, diethyl, di-propyl, and di-butyl tartrate, and alkyl isomers thereof, e.g., tri-isopropyl citrate or di-isopropyl tartrate etc.

Often, the hydroxy carboxy ester is selected from triethyl citrate, tri propyl citrate, tributyl citrate, tripentyl and trihexyl citrate, e.g., triethyl citrate, tri propyl citrate, and tributyl citrate.

The hydroxy carboxy esters of the invention are known compounds, and are either commercially available or readily prepared by known means.

Generally, the metal based friction modifier comprises one or more organo molybdenum compounds such as, for example, molybdenum dialkyldithiocarbamates, molybdenum dialkyl dithiophosphates, molybdenum disulfide, trimolybdenum cluster dialkyldithiocarbamates, non-sulfur molybdenum compounds and the like; for example, a molybdenum dialkyldithiocarbamate friction modifier is often present. Many of these molybdenum compounds are well known and many are commercially available. Other friction modifiers may also be present, including organic fatty acids and derivatives of organic fatty acids, amides, imides, and other organo metallic species for example zinc and boron compounds, etc.

Commercial lubricant formulations typically contain a variety of other additives, for example, dispersants, detergents, corrosion/rust inhibitors, antioxidants, anti-wear agents, anti-foamants, friction modifiers, seal swell agents, demulsifiers, V.I. improvers, pour point depressants, and the like. A sampling of these additives can be found in, for example, U.S. Pat. No. 5,498,809 and U.S. Pat. No. 7,696,136, the relevant portions of each disclosure is incorporated herein by reference, although the practitioner is well aware that this comprises only a partial list of available lubricant additives. It is also well known that one additive may be capable of providing or improving more than one property, e.g., an anti-wear agent may also function as an anti-fatigue and/or an extreme pressure additive.

The lubricant compositions will often contain any number of these additives. Thus, final lubricant compositions of the invention will generally contain a combination of additives, including the inventive friction modifying additive combination along with other common additives, in a combined concentration ranging from about 0.1 to about 30 weight percent, e.g., from about from about 0.5 to about 10 weight percent based on the total weight of the oil composition, For example, the combined additives are present from about 1 to about 5 weight percent. Oil concentrates of the additives can contain from about 30 to about 75 weight percent additives.

Given the ubiquitous presence of additives in a lubricant formulation, the amount of lubricating oil present in the inventive composition is not specified above, but in most embodiments, except additive concentrates, the lubricating oil is a majority component, i.e., present in more than 50 wt % based on the weight of the composition, for example, 60 wt % or more, 70 wt % or more, 80 wt % or more, 90 wt % or more, or 95 wt % or more.

One embodiment of the invention is therefore a lubricant composition comprising

A) from about 70 to about 99.9 wt % of a natural or synthetic lubricating oil,

B) from about 0.01 to about 5 wt %, of the mixture of i) the metal based friction modifier and ii) hydroxy carboxylic ester described above; and C) one or more additional lubricant additive wherein the combined amount of B) and C) present in the composition is from about 0.1 to about 30 weight percent based on the total weight of the lubricant composition.

In another embodiment the lubricating oil is present from about 90 to about 99.5 wt % and the combined amount of B) and C) is from about 0.5 to about 10 weight percent; and in another embodiment the lubricating oil is present from about 95 to about 99 wt % and the combined amount of B) and C) is from about 1 to about 5 weight percent based on the total weight of the lubricant composition.

In one particular embodiment, the lubricant composition comprises;

A) from about 70 to about 99.9 wt % of a natural or synthetic lubricating oil,

B) from about 0.01 to about 5 wt %, of a mixture comprising;

i) a metal based friction modifier selected from the group consisting of molybdenum dialkyldithiocarbamates, molybdenum dialkyl dithiophosphates, molybdenum disulfide, tri-molybdenum cluster dialkyldithiocarbamates, and ii) a hydroxy carboxylic ester selected from the group consisting of $C_{2-6}$ or $C_{3-6}$ straight or branched chain alkyl esters of citric acid; and C) one or more additional lubricant additives selected from the group consisting of dispersants, detergents, corrosion/rust inhibitors, antioxidants, anti-wear agents, anti-foamants, friction modifiers, seal swell agents, demulsifiers, V.I. improvers and pour point depressants, wherein the combined amount of B) and C) present in the composition is from about 0.1 to about 30 weight percent based on the total weight of the lubricant composition.

The natural or synthetic lubricating oil of the invention can be any suitable oil of lubricating viscosity. For example, a lubricating oil base stock is any natural or synthetic lubricating oil base stock fraction having a kinematic viscosity at 100° C. of about 2 to about 200 cSt, about 3 to about 150 cSt, and often about 3 to about 100 cSt. The lubricating oil base stock can be derived from natural lubricating oils, synthetic lubricating oils, or mixtures thereof. Suitable lubricating oil base stocks include, for example, petroleum oils, mineral oils, and oils derived from coal or shale petroleum based oils, animal oils, such as lard oil, vegetable oils (e.g., canola oils, castor oils, sunflower oils) and synthetic oils.

Synthetic oils include hydrocarbon oils and halo-substituted hydrocarbon oils, such as polymerized and interpolymerized olefins, gas-to-liquids prepared by Fischer-Tropsch technology, alkylbenzenes, polyphenyls, alkylated diphenyl ethers, alkylated diphenyl sulfides, as well as their derivatives, analogs, homologs, and the like. Synthetic lubricating oils also include alkylene oxide polymers, interpolymers, copolymers, and derivatives thereof, wherein the terminal hydroxyl groups have been modified by esterification, etherification, etc. Another suitable class of synthetic lubricating oils comprises the esters of dicarboxylic acids with a variety of alcohols. Esters useful as synthetic oils also include those made from monocarboxylic acids or diacids and polyols and polyol ethers. Other esters useful as synthetic oils include those made from copolymers of alphaolefins and dicarboxylic acids which are esterified with short or medium chain length alcohols.

Silicon-based oils, such as the polyalkyl-, polyaryl-, polyalkoxy-, or polyaryloxy-siloxane oils and silicate oils, comprise another useful class of synthetic lubricating oils. Other synthetic lubricating oils include liquid esters of phosphorus-containing acids, polymeric tetrahydrofurans, poly alphaolefins, and the like.

The lubricating oil may be derived from unrefined, refined, re-refined oils, or mixtures thereof. Unrefined oils are obtained directly from a natural source or synthetic source (e.g., coal, shale, or tar and bitumen) without further purification or treatment. Examples of unrefined oils include a shale oil obtained directly from a retorting operation, a petroleum oil obtained directly from distillation, or an ester oil obtained directly from an esterification process, each of which is then used without further treatment. Refined oils are similar to unrefined oils, except that refined oils have been treated in one or more purification steps to improve one or more properties. Suitable purification techniques include distillation, hydrotreating, dewaxing, solvent extraction, acid or base extraction, filtration, percolation, and the like, all of which are well-known to those skilled in the art. Re-refined oils are obtained by treating refined oils in processes similar to those used to obtain the refined oils. These re-refined oils are also known as reclaimed or reprocessed oils and often are additionally processed by techniques for removal of spent additives and oil breakdown products.

Lubricating oil base stocks derived from the hydroisomerization of wax may also be used, either alone or in combination with the aforesaid natural and/or synthetic base stocks. Such wax isomerate oil is produced by the hydroisomerization of natural or synthetic waxes or mixtures thereof over a hydroisomerization catalyst. Natural waxes are typically the slack waxes recovered by the solvent dewaxing of mineral oils; synthetic waxes are typically the waxes produced by the Fischer-Tropsch process. The resulting isomerate product is typically subjected to solvent dewaxing and fractionation to recover various fractions having a specific viscosity range. Wax isomerate is also characterized by possessing very high viscosity indices, generally having a V.I. of at least 130, preferably at least 135 or higher and, following dewaxing, a pour point of about −20° C. or lower.

The friction modifying mixture of metal based friction modifier and hydroxy carboxylic ester of the invention can be added to the lubricating oil directly as a combination or as individual components. The mixture can be added by itself or along with other common additives. A concentrate containing the mixture may also be prepared and added to the lubricating oil. It is also possible to add the friction modifying mixture to a preformulated lubricating oil which already contains all or most of the other formulation components.

The lubricating oil compositions of the invention can be used in a variety of applications, for example, crankcase lubricating oils for spark-ignited and compression-ignited internal combustion engines, gas engine lubricants, turbine lubricants, automatic transmission fluids, gear lubricants, compressor lubricants, metal-working lubricants, hydraulic fluids, and other lubricating oil and grease compositions.

For example, the friction modifying combination of the invention can be used in petroleum, polyester, polyolefin, alkylated aryl, silicon and similar oils commonly encountered in engines used in automobiles, trucks, airplanes, boats, ships and rail transport.

The friction modifying combination of the invention has been found to improve friction reduction over a wide temperature range, e.g., from 40-200° C. in various lubricants, for example, commercially available engine lubricants. The effectiveness of the combination allows for the reduction of metal components in these lubricants. The inventive combination is particularly effective in lubricating oils which may be used at temperatures above, e.g., 90° C., for example, lubricant applications wherein the temperatures may reach 100° C. or higher, such as 130° C., or 160° C. or higher.

EXAMPLES

In the following examples, the friction coefficient over a temperature range of 60-162° C. was determined from Cameron Plint testing of formulated motor oils to which mixtures of molybdenum friction modifiers and citrate esters according to the invention were added. Comparisons were made to the formulated oils without the inventive additive mixture (referred to as standard in the data tables) and/or to formulated motor oils to which only the molybdenum friction modifier or citrate ester was added. The commercial source of molybdenum dialkyldithiocarbamate and tributyl citrate was the same for each example. Ratios are by weight.

Example 1

A formulated, petroleum based 10W-40 motor oil obtained from a commercial supplier was blended with 1% by weight based on the weight of the motor oil, of a mixture of a commercially available molybdenum dialkyldithiocarbamate and tributyl citrate in a weight ratio of 1:1.

Example 2

A formulated, petroleum based 20W-40 motor oil obtained from a commercial supplier was blended with 1% by weight based on the weight of the motor oil, of the 1:1 mixture of molybdenum dialkyldithiocarbamate and tributyl citrate of Example 1.

Results from Examples 1 and 2, and the untreated standards are shown in Table 1.

TABLE 1

| | Friction coefficient (–) | |
|---|---|---|
| | 132° C. | 162° C. |
| 10W-40 Standard | 0.103 | 0.100 |
| 20W-40 Standard | 0.104 | 0.108 |
| Example 1, 10W-40 | 0.030 | 0.029 |
| Example 2, 20W-40 | 0.040 | 0.020 |

Example 3

A commercially obtained, fully formulated, petroleum based 5W-30 motor oil was blended with 1% by weight based on the weight of the motor oil, of the 1:1 mixture of molybdenum dialkyldithiocarbamate and tributyl citrate.

Example 4

The commercially obtained 5W-30 motor oil used in Example 3 was blended with 1% by weight based on the weight of the motor oil, of a 1:3 mixture of the molybdenum dialkyldithiocarbamate and tributyl citrate.

Example 5

The commercially obtained 5W-30 motor oil used in Example 3 was blended with 1% by weight based on the weight of the motor oil, of a 1:9 mixture of the molybdenum dialkyldithiocarbamate and tributyl citrate.

Results from Examples 3-5 and the untreated standard are shown in Table 2.

TABLE 2

| | Friction coefficient (–) | |
|---|---|---|
| | 132° C. | 162° C. |
| 5W-30 Standard formulation | 0.108 | 0.094 |
| Example 3, 1:1 MoFM:citrate | 0.083 | 0.069 |
| Example 4, 1:3 MoFM:citrate | 0.068 | 0.057 |
| Example 5, 1:9 MoFM:citrate | 0.070 | 0.064 |

Example 6

The impact of the combination of the individual components vs the mixture of components was tested. A formulated, commercially available, fully synthetic 5 W 30 oil was treated with 1 wt % molybdenum dialkyldithiocarbamate, with 1 wt % tributyl citrate, and with 1 wt % of a 1:1 mixture of molybdenum dialkyldithiocarbamate and tributyl citrate. Friction coefficients were again measured over a range of temperatures. Results are shown in Table 3.

TABLE 3

| | Friction coefficient (–) | |
|---|---|---|
| | 132° C. | 162° C. |
| Standard | 0.105 | 0.105 |
| Standard plus tributyl citrate | 0.100 | 0.105 |
| Standard plus MoFM | 0.031 | 0.030 |
| Standard plus MoFM and tributyl citrate | 0.035 | 0.028 |

Tributyl citrate alone was ineffective. However, the 1:1 blend of molybdenum friction modifier and tributyl citrate is as good or better in lowering the friction coefficient at higher temperatures than the molybdenum compound alone, even at half the amount of molybdenum.

Example 7

The 5W-30 motor oil used in Example 3 was blended with 3% by weight based on the weight of the motor oil, of a 1:1 mixture of the molybdenum dialkyldithiocarbamate and tributyl citrate.

Example 8

The 5W-30 motor oil used in Example 3 was blended with 3% by weight based on the weight of the motor oil, of a 1:3 mixture of the molybdenum dialkyldithiocarbamate and tributyl citrate.

Example 9

The 5W-30 motor oil used in Example 3 was blended with 3% by weight based on the weight of the motor oil, of a 1:1 mixture of the molybdenum dialkyldithiocarbamate and triethyl citrate.

Example 10

The 5W-30 motor oil used in Example 3 was blended with 3% by weight based on the weight of the motor oil, of a 1:3 mixture of the molybdenum dialkyldithiocarbamate and triethyl citrate.

Comparison Example A

The 5W-30 motor oil used in Example 3 was blended with 3% by weight based on the weight of the motor oil, of dialkyldithiocarbamate.

Comparison Example B

The 5W-30 motor oil used in Example 3 was blended with 3% by weight based on the weight of the motor oil, of and tributyl citrate.

Comparison Example C

The 5W-30 motor oil used in Example 3 was blended with 3% by weight based on the weight of the motor oil, of and triethyl citrate Results from Examples 7-10, Comparison Examples A-C and the untreated standard are shown in Table 4.

TABLE 4

| 3% Additive | Friction coefficient (–) 132° C. | 162° C. |
|---|---|---|
| 5W-30 Standard formulation | 0.107 | 0.100 |
| Example 7, 1:1 MoFM:butyl citrate | 0.034 | 0.029 |
| Example 8, 1:3 MoFM:butyl citrate | 0.050 | 0.028 |
| Example 9, 1:1 MoFM:ethyl citrate | 0.034 | 0.029 |
| Example 10, 1:3 MoFM:ethyl citrate | 0.053 | 0.035 |
| Comp Ex A, 3% MoFM | 0.028 | 0.026 |
| Comp Ex B, 3% tributyl citrate | 0.081 | 0.078 |
| Comp Ex C, 3% triethyl citrate | 0.086 | 0.084 |

Example 11

The 5W-30 motor oil used in Example 3 was blended with 1% by weight based on the weight of the motor oil, of a 1:1 mixture of the molybdenum dialkyldithiocarbamate and tributyl citrate.

Example 12

The 5W-30 motor oil used in Example 3 was blended with 1% by weight based on the weight of the motor oil, of a 1:3 mixture of the molybdenum dialkyldithiocarbamate and tributyl citrate.

Comparison Example D

The 5W-30 motor oil used in Example 3 was blended with 1% by weight based on the weight of the motor oil, of dialkyldithiocarbamate.

Comparison Example E

The 5W-30 motor oil used in Example 3 was blended with 1% by weight based on the weight of the motor oil, of tributyl citrate.

Results from Examples 11 and 12, Comparison Examples D and E and the untreated standard are shown in Table 5.

TABLE 5

| 1% Additive | Friction coefficient (–) 132° C. | 162° C. |
|---|---|---|
| 5W-30 Standard formulation | 0.107 | 0.100 |
| Example 11, 1:1 MoFM:butyl citrate | 0.066 | 0.053 |
| Example 12, 1:3 MoFM:butyl citrate | 0.066 | 0.056 |
| Comp Ex D, 1% MoFM | 0.058 | 0.043 |
| Comp Ex E, 1% tributyl citrate | 0.079 | 0.075 |

What is claimed is:

1. A lubricant composition comprising:

A) 70 wt % or more of a petroleum based automotive motor lubricating oil, and

B) 3 wt % of a mixture of i) a metal based friction modifier selected from the group of molybdenum dialkyldithiocarbamates, and ii) from a hydroxy carboxylic ester selected from the group consisting of triethyl citrate, tripropyl citrate and tributyl citrate;

in a weight ratio of i) to ii) of about 1:3.

2. The lubricant composition according to claim 1 further comprising one or more additional lubricant additive selected from the group consisting of dispersants, detergents, corrosion/rust inhibitors, antioxidants, anti-wear agents, anti-foamants, friction modifiers, seal swell agents, demulsifiers, V.I. improvers and pour point depressants.

3. The lubricant composition according to claim 1 wherein the petroleum based automotive motor lubricating oil is present at about 90 wt % or more.

* * * * *